US006450202B2

(12) United States Patent
Bogdanowicz

(10) Patent No.: US 6,450,202 B2
(45) Date of Patent: Sep. 17, 2002

(54) VALVE

(75) Inventor: Grzegorz Bogdanowicz, Ostfildern (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/785,575

(22) Filed: Feb. 16, 2001

(30) Foreign Application Priority Data

Mar. 4, 2000 (DE) ..... 100 10 690

(51) Int. Cl.[7] ..... F15B 13/043
(52) U.S. Cl. ..... 137/625.66; 137/625.64
(58) Field of Search ..... 137/625.64, 625.66

(56) References Cited

U.S. PATENT DOCUMENTS 3,267,965 A * 8/1966 Kroffke ..... 137/625.66 X
3,949,645 A * 4/1976 Masclet ..... 137/625.66 X
4,197,878 A * 4/1980 Thompson ..... 137/625.66
4,267,862 A * 5/1981 Neff et al. ..... 137/625.66 X
4,319,609 A * 3/1982 Debrus ..... 137/625.66 X
4,524,803 A * 6/1985 Stoll et al. ..... 137/625.66 X
5,666,994 A 9/1997 Stoll et al.

FOREIGN PATENT DOCUMENTS

DE 4244080 A1 9/1993

* cited by examiner

*Primary Examiner*—Gerald A. Michalsky
(74) *Attorney, Agent, or Firm*—Hoffmann & Baron, LLP

(57) ABSTRACT

A valve having a control means for the control of a fluid flow, such control means being able to be caused to move in two opposite switching directions. In order to render possible delay-free switching over after long periods of inactivity, a drive means is provided, which has spring means, which are tensioned when the control means is moved into a terminal switching position. The energy then stored is available for increasing the force during the next switching movement.

18 Claims, 2 Drawing Sheets

VALVE

BACKGROUND OF THE INVENTION

The invention relates to a valve comprising a control means having a valve spool serving for the control of fluid flows, such control means being able to be moved by the application of setting forces in relation to the valve housing in a first switching movement following a first switching direction and an second switching movement following an opposite second switching direction, and is consequently able to be positioned in different switching settings, said control means being able in the first switching movement to be shifted along a displacement path from a first switching position into a preset terminal switching position, which is preset by abutment means on the housing in which terminal position it can be held by first setting forces, which are effective in the first switching direction, and from which it can be moved by the application of second setting forces, acting in the opposite second switching direction, as part of the second switching movement.

THE PRIOR ART.

A multi-way valve of this type is for example disclosed in the European patent publication 0 678 676 B1. Here the control means is constituted by a piston-like valve spool with an axially aligned, preceding setting piston and may be positioned by the action of a control fluid in two mutually opposite terminal switching positions. Dependent on the switching position the valve ducts are linked together with various different configurations.

One problem with all valves of this type when the control means dwells in one of the terminal switching positions for a prolonged period of time, is the static friction between the valve spool and the seals surrounding it. Particularly typical cases of the effect of such behavior occur with dwell times over 2 hours. The consequence is that the setting forces necessary for shifting the control means out of the respective terminal switching position and for switching into an other switching position increase. This again means that the resistance to switching opposing the fluid power driving forces available for actuation is increased so that the switching times increase and this may lead to functional disturbances in the loads connected with the valve. Behavior in the case of monostable or two state valves is particularly critical.

SHORT SUMMARY OF THE INVENTION

One object of the invention is to adopt measures which ensure reliable switching over of the valve even following long periods of disuse.

In order to achieve these and/or other objects appearing from the present specification, claims and drawings, in the present invention there is at least one drive means having spring means which at the start of the first switching movement is as yet ineffective and is only tensioned during the terminal part of the first switching movement by the kinetic energy of the control means, the tension force of the spring means contributing additionally, at the start of the second switching movement, to actuating forces, produced by fluid action, for producing the second setting forces.

On switching the control means over into a terminal switching position there is accordingly firstly a switching movement of the conventional sort. However once the control means has moved along a part of the switching path toward the terminal position, the kinetic energy available at this point in time, of the configuration means causes spring means of at least one drive means to be tensioned. Thus energy is transmitted to the spring means and stored therein. The storage of energy in the spring means continues as long as the control means is held by the first setting forces acting on it in the terminal switching position. These first setting forces are as a rule fluid power setting forces and in the case of monostable valves are more particularly applied by a pneumatic spring. If now the control means is acted upon by a control for the purpose of leaving the terminal position and moving into the second switching position, initially the tension forces of the spring means will be added to its actuating forces, this being sufficient to overcome the increased static friction and to switch over the control means. Delays in switching may consequently be effectively prevented even in the case of prolonged periods of idleness of the valve.

Further advantageous developments of the invention are defined in the claims.

It is possible to provide at least one drive means containing the spring means mounted stationarily on the valve housing, the tensioning of the spring means occurring because on approaching the terminal position the moving control means strikes against an impact face drivingly connected with the spring means.

Additionally or alternatively it is possible for at least one drive means to be provided on the control means as well so that it is borne by it and is entrained during the switching movements. Such a design may as a rule be manufactured substantially more simply than one involving integration in the valve housing. This is more particularly so when the drive means is integrated in a setting piston of the control means which represents a part separate from the valve spool so that it is may be employed extremely simply instead of a conventional setting piston.

The tensioning of the spring means is preferably performed by compressing the spring means between the moving control means and the support means secured to the housing, when the control means draws close to its terminal switching position. The necessary displacement path for tensioning the spring means may in this case be extremely small and more particularly substantially less than the rest of the displacement path of switching, in which the spring means is not yet functional and is not yet compressed. This means that during the switching movement there will be sufficient time for the control means to accumulate the kinetic energy necessary for tensioning or cocking the spring means.

The impact face struck at the start of the tensioning operation and associated with the spring means is preferably on a sliding plunger as part of the drive means, such plunger being able to be adjusted and running directly in the valve housing or in the control means.

In order to obtain the desired characteristic it is convenient to provide for the spring means to be subject to a certain bias even in the non-actuated state thereof. In this respect it is possible to provide adjustment means, rendering possible a predetermined presetting of the spring means. Such presetting means furthermore render possible the compensation of manufacturing inaccuracies as regards the length of the spring means, more especially when such spring means are constituted by at least one mechanical spring. As an alternative or in addition to having at least one mechanical spring it is possible for the spring means to be also constituted by a gas spring and in this case preferably a pneumatic spring.

The drive means is preferably associated with an axially terminal region of the control means. In the case of a control means having two terminal switching positions it is possible to associate a drive means with both terminal switching positions, preferably at the two axial ends of the control means.

If the first setting forces are provided by a gas spring, preferably a pneumatic spring, for example in order to produce a monostable two-state valve, the design will preferably be such that the resilient force of the spring means at least approximately equals the first setting forces or is somewhat less than they are. It is in this manner that the first setting forces may be substantially compensated for when the control means is in the terminal switching position, by the resilient force so that the actuating forces to be provided by an operating or drive fluid essentially only have to overcome the static friction of the sealing means in order to switch over the control means out of the terminal switching position into another switching position.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
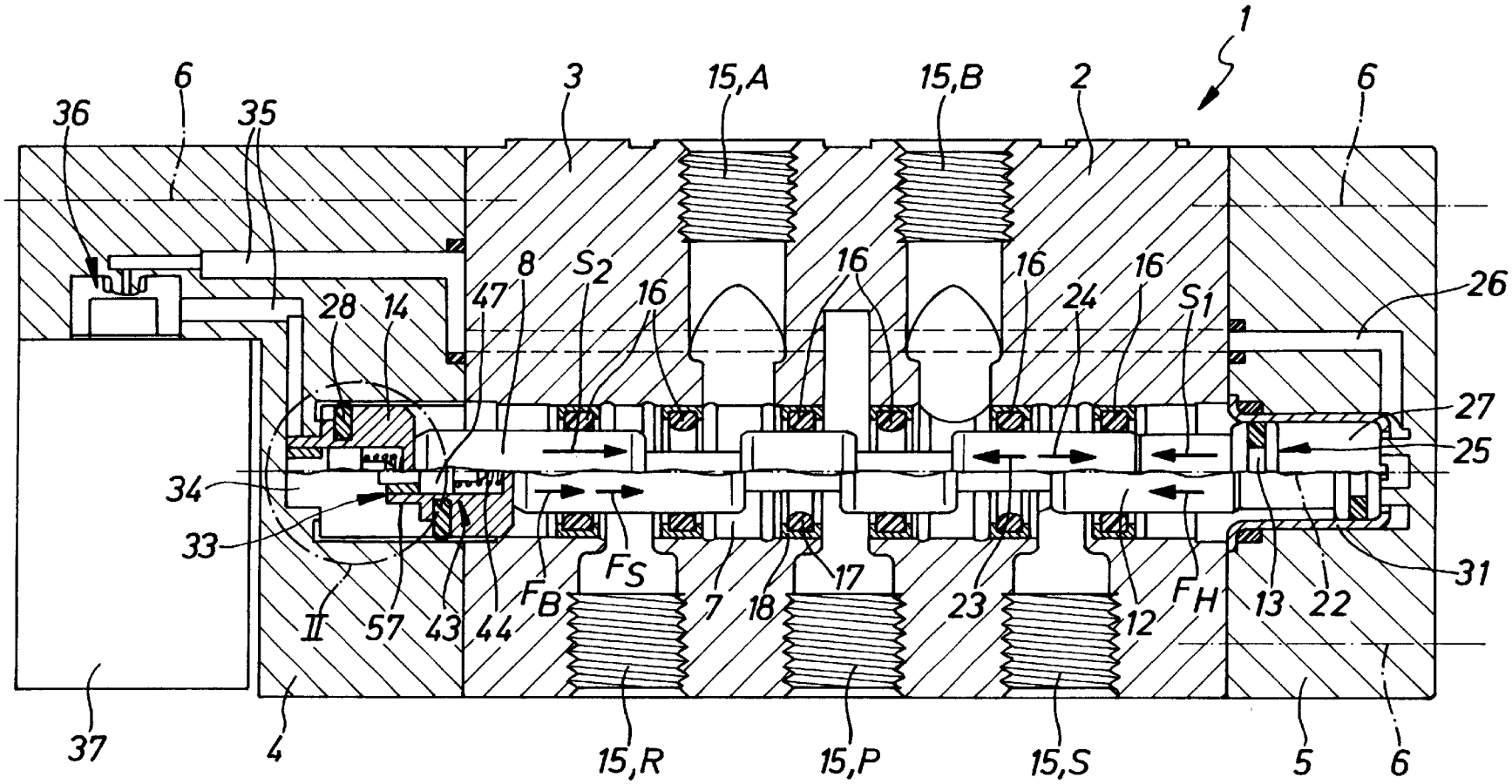
FIG. 1 shows a preferred embodiment of the invention in the form of a valve having the novel features, which in the present case is a monostable 5/2 way valve, all in a longitudinal section and partly diagrammatically.

In the case of the valve 1 depicted in the drawing it is a question of a multi-way valve, and more specifically of a 5/2 way valve.

The valve 1 possesses a valve housing 2, which in the present case has a body 3, at whose two axial end faces a terminating body 4 and 5 is arranged. Suitable attachment means for securing the terminating bodies 4 and 5 on the principal body are indicated in chained lines at 6, it being for instance a question of attachment screws.

In the interior of the valve housing 2 there extends an elongated receiving space 7 in the longitudinal direction, wherein a control means 8, also of elongated form, is accommodated. The control means 8 comprises a piston-like, elongated valve spool 12 and furthermore two setting pistons 13 and 14 placed in front of the two axial end faces of the valve spool 12.

A plurality of valves 15 laterally open into the receiving space 7 at positions spaced apart in the longitudinal direction, the receiving space sections communicating with the individual valve ducts being flanked on either side axially by an annular sealing means 16. Between axially adjacent sections there is merely one sealing means 16 respectively. The valve spool 12 has regions with a large and small cross section respectively alternating in the longitudinal direction, which regions dependent on the axial setting of the valve spool 12 cooperate or do not cooperate with individual sealing means 16, which in the working example are secured to the housing in a fixed manner. If there is sealing contact, the receiving space sections on either side of the respective seal means 16 are separated from each other in a fluid-tight fashion. If on the contrary a region with a small cross section of the valve spool 12 is at the same level as a sealing means 16, an intermediate space will result, through which receiving space sections are connected with each other with the result that a fluid pressure medium may transfer between the valve ducts 15 communicating with each other.

In the working embodiment illustrated one of the valve ducts 15 is a feed duct P, by way of which a pressure medium to be distributed, more especially compressed air, may supplied by way of the valve. On either side and adjacent to the feed duct P a respective power duct A and B opens into the receiving space 7, such power ducts A and B being able to be connected with a load, as for instance a pneumatic power cylinder. Axially to the outside a venting duct R and S joins with each power duct A and B.

The sealing means 16 surround the control means 8 coaxially, each of them comprising an annular sealing body 17 of a suitable sealing material, as for example an elastomeric body. The sealing body 17 is in the present working example held by way of an annular and radially inwardly open sealing housing 18, which is fixed in place by means of the sealing means 16 against the inner face of the receiving space 7, for example by being pressed into position.

The sealing contact between one sealing means 16 and the control means 8 is produced because the sealing body 17 surrounds a section with a large diameter of the valve spool 17 in a sealing manner.

In the working embodiment illustrated the control means 1 is able to be switched over between two switching positions. The first possible switching position is indicated in FIG. 1 underneath the longitudinal axis 22 of the receiving space 7, whereas the second switching position—in the following termed the terminal switching position—is depicted above the longitudinal axis 22.

In the first switching position there will, in the present working example, be such an association or coordination of the valve ducts that the feed duct P will be connected with the one power duct B, whereas at the same time the other power duct A will communicate with the one venting duct R. The second venting duct S is in this case shut off. Unlike this in the terminal switching position the feed duct P will connect with the power duct A which previously was still vented, while simultaneously the other power duct B is vented by way of the venting duct S which was previously still shut off. In this case the other venting duct R still remaining is shut off.

The movement taking place for shifting the control means 8 out of the first switching position into the terminal switching position will be termed the first switching movement and is in a first switching direction 23 as indicated by the arrow. The shift of the control means 8 out of the terminal switching position into the first switching position will be termed the second switching movement and takes place in a second switching direction 24 which is opposite to the first switching direction 23 and is also as indicated by an arrow. The switching directions are in the same direction as the longitudinal axis 2.

In the case of the valve of the embodiment of the invention it is a question of a monostable valve, which has its preferred switching position in the terminal switching position. This position is maintained because the one setting piston 13, indicated on the right in FIG. 1, has its first working face 25, which is opposite the valve spool 12, constantly subjected to fluid pressure medium under a predetermined actuating pressure. In the embodiment of the invention such fluid pressure medium is drawn through a first actuating duct in the interior of the valve housing 2 from the feed duct P and fed into a first working space 27 defined by the associated terminal region of the receiving space 7, such space 27 being also delimited by the moving setting piston 12 and, respectively, its first working face 25.

By means of the pressure medium acting on the first working face 25 the control means 9 is subjected to setting forces $S_1$, which are effective in the first switching direction 23.

Owing to the continuous connection of the first working space 27 with the feed duct P there is, in the embodiment, a pneumatic spring owing to the compressed air located in the first working space 27, and such pneumatic spring constantly urges the control means 8 with the first setting forces $S_1$.

The second setting piston 14 associated with the opposite axial terminal region of the valve spool 12, is, like the other, first setting piston 13, arranged to slide in the associated terminal section of the receiving space 7 while being sealed off. For sealing an annular sealing means 28 may be provided, which is seated in an annular groove in the respective setting piston 13 and 14 and is in sliding contact with the radially facing bore face 32 of the receiving space 7.

At a second working face 33 axially remote from the valve spool 12 the second setting piston 14 delimits a second working space 34 defined by the associated terminal section of the receiving space 7. The working space 34 is, just like the first working space 27, connected with the feed duct P by way of a second actuating duct 35, it however being a question of a controlled connection. This is because a pilot valve 36 is arranged in the second actuating duct 35, such valve 36 having an electrically operated actuating means 37, as for example an electromagnet or a piezoelectric means, by which the passage of fluid along the second actuating duct 35 may be shut off or permitted at will. When the second actuating duct 35 is shut off, the second working space 34 is vented by a duct means, not illustrated in detail, and arranged for example within the actuating means 37. When the connection is open the means serving for venting is shut off and instead of it the second working space 34 is connected with the feed duct P with the result that control fluid from the feed duct P will be supplied to the second working space 34, such control fluid acting on the second working face 33 and hence exerting actuating forces FB as indicated by the arrow, in the second switching direction 24 on the control means 8.

Instead of being supplied through a branch duct from the feed duct P the control fluid could be supplied through a separate control duct, something which also applies for the pressure medium serving for acting on the first setting piston 13.

Preferably the receiving space 7 extends in the longitudinal direction through the entire principal body 3 right into the second terminating bodies 4 and 5. At least for the major part of their displacement path the setting pistons 13 and 14 are moved within the associated receiving terminating body 4 and 5, a further sleeve 38 being fitted optionally in the respective terminal section of the receiving space 7 to produce an optimum sliding face. The actuating means 37 is preferably also provided on one of the terminating bodies 4.

If the supply of control fluid into the second working space 34 is interrupted by the actuating means 37 and if the space is vented, starting from the first switching position there will be a displacement of the control means 8 in the first switching direction 23 until finally the first terminal switching position is reached as defined by the control means 8 having first abutment means 38 (provided on it) in engagement with second abutment means 39 on the housing. In the working embodiment illustrated the latter abutment means 39 are constituted the terminal face 41 (turned toward the control means 8 in the axial direction) of the receiving space 7. The abutment means 38 provided on the control means 8 are in the working example located on the setting piston 14 and are preferably constituted by its end face 42 axially facing the terminal face 41.

In order to move the control means 8 out of the terminal switching position again and to return it to the first switching position, by activation of the actuating means 37 the passage of fluid along the second actuate duct 35 is opened, something which results in causing the above mentioned actuating forces FB to be effective in the second switching direction 24. Together with a tensioning or biasing force $F_s$, which will be explained later and is in the same direction, such forces $F_B$ produce second setting forces $S_2$, which together are larger than the first setting forces $S_1$ and the static friction forces $F_H$ acting by way of the sealing means 16 on the control means 8. Accordingly the control means 8 is moved in the first switching position free of delay.

Figure 2:
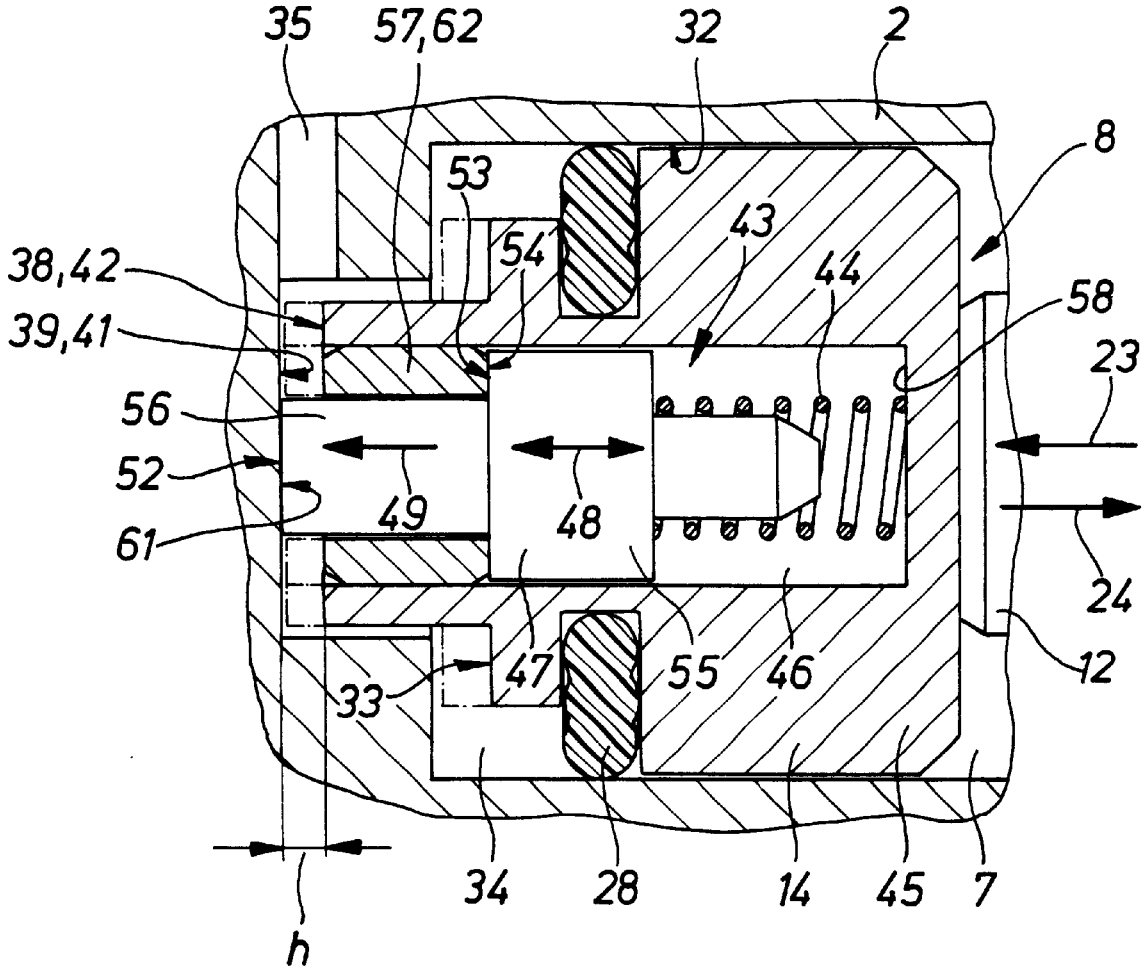
FIG. 2 shows the portion II marked in chained lines in FIG. 1 on a larger scale, full lines being employed to indicate one position of the control means directly prior to the start of tensioning of the spring means, whereas the terminal switching position with the spring means tensioned is indicated in chained lines.

An important point with the present invention is the feature of making available the above mentioned tensioning force $F_S$ by a drive means 43 shown on a larger scale in FIG. 2, which preferably, as illustrated, is integrated in the setting piston 14 and consequently is borne by the control means 8.

The drive means 43 is provided with spring means 44, which while the first switching movement is taking place are tensioned for producing the tensioning or bias force $F_S$. However the arrangement is such that the spring means 44 do not take effect at the start of the first switching movement and preferably during the major part of the switching displacement and it is only during the terminal section of the first switching movement, that is to say during the movement through the section coming directly prior to the terminal switching position, that they are subjected to tension. Such tensioning is performed by the kinetic energy of the control means 8, which is accumulated on passing through the section, which is not braked by the spring means 44, of the first switching movement. As long as the control means 8 is held by the first setting forces $S_1$ in the terminal switching position, the tensioning force $F_S$ will remain stored in the spring means 44. If however the fluid actuating forces $F_B$ take effect as well, the control means 8 will be moved by the excess of force in the second switching direction 24, the spring means 44 releasing the stored energy in the form of the force $F_S$ to the control means 8 and serving to provide an optimum initial acceleration characteristic or function for the control means 8.

The preferred design employed in the working example is such that the drive means 43 possesses a drive space 46 formed in the setting piston 14 constituting the one principal body 45. A drive plunger 47 is mounted in the drive space 46 in a manner able to follow switching movements axially as indicated by the double arrow 48. The spring means 44, accommodated in the drive space 46, bear on the one hand against the principal body 45 and on the other hand against the drive plunger 47 and urge same in an outward movement direction 49, which is in the same direction as the first switching direction 23. As long as the control means 8 dwells in the first switching position, the drive plunger 47 will be held in the home position indicated in FIG. 2 in full lines, in which home position an impact face 52 provided on it and facing in the outward movement direction 49, is advanced relative to the first abutment means 38 at a distance from the terminating face 41 of the receiving space 7. This distance indicated as "h" in FIG. 2 at the same time constitutes the maximum possible tensioning displacement of the spring means 44.

The home position of the drive plunger 47 is predetermined by first and second abutment faces 53 and 54 which cooperate together and face each other, on the drive plunger 47 and on the setting piston 14.

The drive plunger 47 is stepped in the longitudinal direction and possesses an impact section 56 having the impact face 52 at its end, such impact section 56 axially adjoining an abutment section 55 with a larger diameter. The first abutment face 53 is provided on the end face (which radially projects past the impact section 56 and faces in the outward movement direction 49) of the abutment section 55, whereas the second abutment face 54 is to be found on a sleeve body 57, which coaxially surrounds the impact section 56 and extends into the drive space 46. The spring means 44 bear on the one hand against the rear side, opposite in direction to the first abutment face 53, of the abutment section 55 and on the other hand against the inner limiting face 58, opposite to the latter at a distance a, of the drive space 46.

Opposite to the impact face 52 in the first switching direction 23 there is a mating impact face 61 on the valve housing.

In the first switching position of the control means 8 both the first and also the second abutment 38 and 39 and furthermore the impact face 52 and the mating impact face 61 are arranged at a relatively large distance apart. The drive plunger 47 is here in the home position.

If starting in the first switching position switching movement is commenced, conditions will initially not change at all. Although the above mentioned distances apart will decrease, this will take place without mutual contact occurring. Accordingly at the start of the first switching movement and proceeding from it the spring means 44 will be of no effect during the major part of the movement.

This will be different when toward the end of the first switching movement the impact face 52 strikes the mating impact face 61. At this point in time the two first and second abutment means 38 and 39 are still spaced apart by the tensioning distance h. Owing to the kinetic energy of the control means 8 the latter will however not be halted and instead will move farther until there is mutual contact between the first and the second abutment means 38 and 39 relative to the drive plunger 47, which for its part is hindered from moving on farther. When this takes place the drive plunger 47 will be thrust in relation to the setting piston 14 axially into the drive space 46, this leading to a tensioning of the spring means 44. The end or terminal switching position is for this reason characterized by both the impact face 52 and also the mating impact face 61, furthermore also the two abutment means 38 and 39, contacting one another, the spring means 44 being tensioned for the tensioning or displacement or path. In FIG. 2 the state in the terminal switching position are indicated in chained lines.

The tensioning of the spring means 44 takes place in the working example by compressing same. Here it is a question of one or more mechanical springs, preferably compression springs. However other types of spring would be possible and it would be possible to have recourse to a gas spring, preferably in the form of a pneumatic spring, the air cushion being produced for instance by tapping compressed air from the ducts present in the valve 1.

As long as the control means 8 is located in the terminal switching position, the tensioned spring means 44 acting by way of the mutual contact of the impact face 52 and the mating impact face 61 will produce the above mentioned spring force $F_S$, which urges the control means 8 in the second switching direction. However the tension force $F_s$ does not suffice by itself to cause the second switching movement. It is only when the actuating means 37 is activated and by supply of the control fluid and the actuating forces $F_B$ are increased, that the setting forces S2 come into play, which are higher than the first setting forces $S_1$ and the static friction forces $F_H$, such second setting forces S2 moving the control means 8 back into its first switching position.

The tension force $F_S$ acts however during the initial phase of the second switching movement along a fraction corresponding to the tensioning displacement h. Even although this tensioning displacement h is extremely small—it may for instance amount something of the order of 5/10 mm—the stored spring energy is sufficient to contribute to overcome the initially high static friction forces $F_H$ and to start motion of the control means 8. As soon as the control means 8 moves, the actuating forces $F_B$ are sufficient to move the control means 8 back into the first switching position and despite the constant fluid action of the first working space 27 hold such position as long as desired.

Preferably the design of the valve 1 is such that on the basis of identical fluid pressures in the two working spaces 27 and 34 the tension force FS of the tensioned spring means 44 is of equal size or is slightly less than the first setting forces $S_1$ produced by pneumatic spring effect. Despite there being equal forces it is possible from the spring means 44 to be kept tensioned, because the impact face 52 owing to the initially unhindered movement of the control means 8 impacts against the mating impact face 61 and owing to kinetic energy compression of the spring means 44 is possible. The fact that the control means 8 still remains in the terminal switching position is related to the static friction forces $F_H$ due to the sealing means 16. If now switching over of the control means 8 is to take place, it is necessary for the control pressure supplied by way of the second actuating duct 35 to only overcome the static friction, something which is readily possible so that the control means 8 is practically free of delay.

For presetting a desired characteristic of the spring means 44 it is an advantage if they are under a certain bias even in the home position of the drive plunger 47. In the working embodiment illustrated it is possible for the presetting action to be set as desired by the selection of a suitable axial depth of fitting of the sleeve body 57 in relation to the drive space 46. The sleeve body 57 hence here constitutes the adjustment means 62 for presetting the bias of the spring means 44, different depths of fitting being here produced by thrusting the sleeve body 57 for different distances into the drive space 46. As an alternative it would however be possible for example to design the sleeve body as a screw component and to set of fitting by varying the depth of screwing home at will.

More particularly in connection with the design of the valve spool 12 it would be possible to arrange the drive means 43 at a position different to that in the axial terminal region of the control means 8. It is furthermore possible to design a control means 8, which is able to be shifted between two terminal switching position, with a plurality of drive means, which starting from the terminal switching positions would reinforce the return movement. For this purpose, more particularly, a respective drive means could be provided on the two axial possible regions of the control means 8.

In the case of a further embodiment, not illustrated, at least one drive means is arranged alternatively or in addition on the valve housing. The arrangement could then be for example so visualized that the principal body 45 would be arranged on the housing and the moving impact face 52 would extend toward the mating impact face 61 provided on the control means 8. In this case there would be more particularly the possibility of using the valve housing 2 directly as the principal body for supporting the spring means 44 and possibly as a bearing means for the drive piston 47.

One or both of the setting pistons 13 and 14 could certainly be so fixedly attached to the valve spool 12 that they could transmit the pulling and thrust forces to the valve spool 12. More particularly in the case of a drive means 43 provided on a setting piston however a design separate as regards the valve spool 12 is advantageous, because this would render possible easy upgrading of conventional valves simply by using or inserting a setting piston fitted with a drive means 43 instead of a conventional setting piston.

What is claimed is:

1. A valve comprising:

a control means having a valve spool serving for the control of fluid flows, such control means being able to be moved by the application of setting forces in relation to a valve housing in a first switching movement following a first switching direction and a second switching movement following an opposite second switching direction, said control means being able in the switching movement to be shifted along a displacement path from a first switching position for generating a first fluid output condition into a present terminal switching position for generating a second fluid output condition, the first switching position being operably adjacent to the terminal switching position, the control means being held in the terminal switching position by a first setting force such that a fixed end portion of the control means engages against a fixed abutment on the housing thereby preventing any further first switching movement, the control means can be moved from the terminal switching position by the application of second setting forces, acting in opposite second switching direction, as part of the second switching movement, and at least one drive means having spring means which at the start of the first switching movement is as yet ineffective and is only tensioned during the terminal part of the first switching movement by the kinetic energy of the control means, the tension force of the spring means contributing additionally, at the start of the second switching movement, to actuating forces, produced by fluid action, for producing the second setting forces.

2. The valve as set forth in claim 1, comprising at least one drive means on the valve housing, said drive means having at least one impact face operatively connected with the spring means, on which impact face the control means can abut for tensioning the spring means using an oppositely placed mating face.

3. The valve as set forth in claim 2, wherein the impact face is provided on a drive plunger able to move in relation to a principal body of the drive means in the switching direction, on which drive plunger spring means bearing against the principal body act.

4. The valve as set forth in claim 3, wherein the principal body is formed by the valve housing or by the control means in accordance with the placement of the drive means.

5. The valve as set forth in claim 1, comprising at least one drive means supported by the control means, said drive means having an impact face operatively connected with the spring means, which may strike an oppositely placed mating face on the housing for tensioning the spring means.

6. The valve as set forth in claim 3, wherein the drive means is provided in a setting piston of the control means and operatively connected with the valve spool.

7. The valve as set forth in claim 6, wherein the setting piston and the valve spool are designed in the form of mutually separate parts.

8. The valve as set forth in claim 1, wherein at least one drive means is located in an axial terminal region of the control means.

9. The valve as set forth in claim 1, wherein the control means is able to be shifted between two terminal switching positions, at least one drive means being effective in both terminal switching positions.

10. The valve as set forth in claim 9, wherein at least one drive means is located in an axial terminal region of the control means and wherein a respective drive means is provided in the two axial terminal regions of the control means.

11. The valve as set forth in claim 1, wherein the spring means are continuously subjected to a biasing action.

12. The valve as set forth in claim 1, comprising adjustment means for predetermining the bias of the spring means.

13. The valve as set forth in claim 1, wherein the spring means comprise at least one mechanical spring.

14. The valve as set forth in claim 1, wherein the spring means comprise at least one gas spring.

15. The valve as set forth in claim 1, comprising at least one actuating means for the control of the action of a control fluid acting in the second switching direction on the control means.

16. The valve as set forth in claim 1, wherein the first setting forces are produced by a gas spring.

17. The valve as set forth in claim 1, wherein the first tension force of the spring means is at least generally equal to the first setting forces.

18. A valve comprising:

a control means having a valve spool for controlling fluid flows, the control means being movable by the application of setting forces between a first switching position for generating a first fluid output condition and a terminal switching position for generating a second fluid output condition, the first switching position being operably adjacent to the terminal switching position, movement of the control means from the first switching position to the terminal switching position constituting a first switching movement, and movement of the control means from the terminal switching position to the first switching position constituting a second switching movement opposite to that of the first switching movement, the control means being held in the terminal switching position by a first setting force such that a fixed end portion of the control means engages against a fixed abutment on a valve housing thereby preventing any further first switching movement, and the control means including at least one drive means having a spring means which at the start of the first switching movement is ineffective and is only tensioned during a terminal part of the first switching movement by the kinetic energy of the control means, the tension force of the spring means contributing, at the start of the second switching movement, to actuating forces, produced by fluid action, for moving the control means to the first switching position.

* * * * *